US006264005B1

(12) United States Patent
Kang et al.

(10) Patent No.: US 6,264,005 B1
(45) Date of Patent: Jul. 24, 2001

(54) METHOD FOR CONTROLLING RESCUE OPERATION OF ELEVATOR CAR DURING POWER FAILURE

(75) Inventors: Seog Joo Kang; Gueon Sang Han, both of Inchon (KR)

(73) Assignee: LG Industrial Systems Co., Ltd., Seoul (KR)

( * ) Notice: Subject to any disclaimer, the term of this patent is extended or adjusted under 35 U.S.C. 154(b) by 0 days.

(21) Appl. No.: 09/457,363

(22) Filed: Dec. 9, 1999

(30) Foreign Application Priority Data

Dec. 12, 1998 (KR) ..... 98-54649

(51) Int. Cl.[7] ..... B66B 1/06
(52) U.S. Cl. ..... 187/290; 187/296
(58) Field of Search ..... 117/293, 296, 117/297, 290; 318/692, 375, 376, 798–815, 606, 607, 105, 107; 307/48, 64, 66

(56) References Cited

U.S. PATENT DOCUMENTS 4,475,631 * 10/1984 Nomura ..... 318/759
4,484,664 * 11/1984 Nomura ..... 187/29 R
4,489,811 * 12/1984 Yonemoto et al. ..... 187/29 R
4,519,479 * 5/1985 Tanahashi ..... 318/453
4,629,034 * 12/1986 Inaba et al. ..... 187/29 R
4,779,709 * 10/1988 Mitsui et al. ..... 187/119
4,785,914 * 11/1988 Blain et al. ..... 187/105
4,982,815 * 1/1991 Arabori et al. ..... 187/105
5,419,411 * 5/1995 Hasegawa ..... 187/286
5,945,644 * 8/1999 Jang ..... 187/296

FOREIGN PATENT DOCUMENTS

0123456-A1 * 1/2000 (EP) ..... 100/100

* cited by examiner

*Primary Examiner*—Jonathan Salata

(57) ABSTRACT

The present invention relates to a technique for an elevator car to perform an emergency operation during a power failure, and in particular to a method for controlling a rescue operation of an elevator car which can rescue passengers by performing an emergency operation with an electromotive force of a permanent magnet-type synchronous motor during the power failure, in an elevator system employing the synchronous motor as a lifting motor. The method for controlling the rescue operation of the elevator car includes: a step for obtaining the electromotive force by rotating the synchronous motor due to the weight difference between the balance weight and the car during the power failure; a step for charging the electromotive force in the condenser; and a step for gradually increasing a rotation speed of the synchronous motor from a starting time thereof to a predetermined time for speed controlling matched with a charging voltage of the condenser at an initial stage of the power failure.

5 Claims, 4 Drawing Sheets

METHOD FOR CONTROLLING RESCUE OPERATION OF ELEVATOR CAR DURING POWER FAILURE

BACKGROUND OF THE INVENTION

1. Field of the Invention

The present invention relates to a technique for an elevator car to perform an emergency operation at a state of emergency such as power failure, and in particular to a method for controlling a rescue operation of an elevator car which can rescue passengers by performing an emergency operation with an electric power generating of a permanent magnet-type synchronous motor when an emergency such as power failure takes place in an elevator system employing the synchronous motor as a lifting motor.

2. Description of the Background Art

When a permanent magnet-type synchronous motor is employed as a lifting motor in an elevator system, a permanent magnet is used as a magnetic field source, and thus a magnetic component current is not necessary. In addition, in general, the permanent magnet-type synchronous motor is more efficient than an induction motor, and accordingly improves efficiency of the whole elevator system and reduces energy consumption. Therefore, the permanent magnet-type synchronous motor has been used in the elevator system. In the elevator system using the permanent magnet-type synchronous motor as the lifting motor, a conventional apparatus for controlling an operation of an elevator car at a state of emergency, such as power failure, and a method therefor will now be described with reference to FIG. 1.

As illustrated in FIG. 1, the conventional apparatus for controlling the operation of the elevator car (hereinafter referred to as 'car') includes: a converter 102 converting an alternating current from a three-phase alternating current power source 101 to a direct current; a condenser 103 charging and smoothing a direct current outputted from the converter 102; an inverter 104 for inverting a direct current outputted from the condenser 103 to an alternating current by switching of a switching device; a synchronous motor 105 driven by an output from the inverter 104; a contactor 105A closed during the power failure for grounding a three-phase output terminal of the synchronous motor 105 through a ground resistance 105B; a current detector 106 detecting a current supplied from the inverter 104 to the synchronous motor 105; a speed and position detector (such as a rotary encoder outputting a pulse signal corresponding to a rotation speed of the synchronous motor) connected to the synchronous motor 105, and detecting a rotation speed of the synchronous motor 105 and a moving position of the car 110; a traction machine 108 receiving a rotation force from the synchronous motor 105, and driving the car 110 and a balance weight 111 in opposite directions; a brake 109 of the traction machine 108; a power failure detector 112 detecting a state where the three-phase alternating current power source 101 is abnormally inputted or interrupted; a controller 113 outputting a speed command driving the synchronous motor 105 during a normal operation, and outputting a corresponding speed command when the power failure or abnormality detection signal is outputted from the power failure detector 112; an inverter controller 114 receiving an output signal from the current detector 106 and the speed and position detector 107, and outputting a pulse width modulation signal according to a control command of the controller 113; and a gate driving unit 115 receiving the pulse width modulation signal, amplifying it to a predetermined level, and outputting it to the inverter 104. The operation of the conventional apparatus for controlling the operation of the elevator car will now be explained.

In the normal operation, the three-phase alternating current power source 101 is converted into the direct current through the converter 102, and smoothed by the condenser 103. The smoothed direct current is inputted into the inverter 104.

In this state, when the controller 113 transmits the speed command to the inverter controller 114, the inverter controller 114 outputs the pulse width modulation signal having a predetermined pattern which is a gate driving signal to the inverter 104 through the gate driving unit 115. Accordingly, the switching devices in the inverter 104 are switched, and thus a three-phase driving voltage is supplied to the synchronous motor 105.

The synchronous motor 105 rotates at a speed corresponding to the inputted three-phase driving voltage, the rotation force thereof is transmitted to the traction machine 108, and thus the car 110 starts to move to a designated floor.

On the other hand, when the emergency such as the power failure is detected by the power failure detector 112, and when the detection signal is inputted to the controller 113, the driving of the inverter 104 is interrupted. At the same time, the brake 109 of the traction motor 108 is operated, and thus the car 110 stops at a current position. An auxiliary power source which is prepared for the emergency state such as the power failure, namely a battery (not shown) is supplied to the controller 113, the contactor 105A is closed according to the control of the controller 113, and thus an output terminal of the synchronous motor 105 is connected to the ground through the contactor 105A and the ground resistance 105B.

In this state, when the brake 109 is released, the car 110 starts to move towards a heavier side between the car 110 and the balance weight 111, and thus the synchronous motor 105 is rotated. Accordingly, a electric power is generated by the synchronous motor 105, that is the synchronous motor 105 operates as a power generator. A generated current flows through the contactor 105A and the ground resistance 105B, and a braking torque is generated in the synchronous motor 105.

Accordingly, in a state where the driving of the inverter stops, the car 110 moves at such a speed that the braking torque of the synchronous motor 105 and the torque by the weight difference between the car 110 and the balance weight 111 could be balanced. When the car 110 reaches to a door zone of the nearest floor, the brake 109 of the traction motor 108 is driven, and thus the movement of the car 110 stops. At this time, the door is opened, and the passengers are rescued.

However, the conventional apparatus for controlling the operation of the elevator car includes the contactor and the resistor in the circuit of synchronous motor and the inverter, and further includes a control circuit in order to short the output terminal of the synchronous motor to the ground by controlling the contactor during the emergency operation, thereby incurring additional expenses. Moreover, the operational speed of the car is determined merely by the weight difference between the car and the balance weight, and the ground resistance value. Accordingly, there is a disadvantage in that the operational speed is varied according to a load status of the car, namely the number of the passengers and cargo.

SUMMARY OF THE INVENTION

It is therefore a primary object of the present invention to provide a method for controlling a rescue operation of an elevator car during a power failure by controlling a speed and a torque of a permanent magnet-type synchronous motor with an electricity generating power thereof, not by operating the car with a battery power and a balance of a braking torque and a torque by a weight difference between the car and a balance weight It is another object of the present invention to provide a method for controlling a rescue operation of an elevator car during a power failure, without using a contactor and a ground resistance.

In order to achieve the above-described objects of the present invention, there is provided a method for controlling a rescue operation of an elevator car during a power failure by using an elevator system including: a rope; an elevator car connected to one end portion of the rope for transferring passengers or cargo; a balance car connected to the other end portion of the rope for keeping the balance with the elevator car; a traction motor moving the car in a vertical direction by winding or releasing the rope; a three-phase alternating current synchronous motor for providing a driving force rotating the traction motor in a clockwise or counterclockwise, and having a permanent magnet generating electric power by rotating of a rotor due to a weight difference between the balance weight and the car during the power failure; a three-phase alternating current power source supplying an alternating current power; a converter converting an alternating current from the three-phase alternating current power source into a direct current; an inverter having switching devices for each phase provided with a gate for switching control, respectively, converting a direct current from the converter into a three-phase alternating current, and outputting it to the motor; a condenser for charging, smoothing and outputting a direct current from the converter during the normal operation, and receiving a generated current from the motor through the inverter, and charging, smoothing and outputting it during the power failure; a power failure detector connected to the three-phase alternating current power source for detecting the power failure; a controller receiving a power failure detection signal output from the power failure detector, and outputting a speed command signal and a magnetic excitation component current command signal to the motor; a speed and position detector having an encoder for outputting a pulse signal corresponding to a rotation angle of the motor; a current detector for detecting and outputting each phase current of the three-phase alternating current outputted from the inverter to the motor; an inverter controller outputting voltage command signals of pulse width-modulated three phases on the basis of the speed command signal and the excitation component current command signal from the controller, each phase current from the current detector, and the pulse signal from the encoder; a gate driving unit driving a gate of the inverter; and a direct current voltage detector for detecting a direct current voltage at both ends of the condenser, and for supplying the direct current voltage to the inverter controller, the inverter controller being provided with a speed detector for computing a current speed of the car depending on the pulse signal from the encoder, and outputting a computed speed signal; a speed controller for outputting a torque component current command signal to compensate a difference between a command speed according to the speed command signal from the controller and a detection speed according to the detection speed signal from the speed detector; a first coordinate converter for converting and outputting the current signal from the current detector into an excitation component current detection signal and a torque component current detection signal depending on the pulse signal from the encoder; an excitation component current controller outputting an excitation component voltage control signal for compensating a difference between an excitation component current command value according to the excitation component command signal from the controller and an excitation component current detection value according to the excitation component current detection signal from the first coordinate converter; a torque component current controller for outputting a torque voltage control signal to compensate a difference between a torque component current detection value according to the torque component current detection signal from the first coordinate converter and a torque component current command value according to the torque component current command signal from the speed controller; a second coordinate converter for converting and outputting the excitation component voltage control signal from the excitation component current controller and the torque voltage control signal from the torque component current controller into voltage control signals of three phases according to the pulse signal from the encoder; and a pulse width modulator respectively pulse width modulating and outputting the voltage control signals of three phases outputted from the second coordinate converter, the method comprising; a step for obtaining the electricity generation by rotating the synchronous motor due to the weight difference between the balance weight and the car during the power failure; a step for charging the generated electricity into the condenser; and a step for gradually increasing a rotation speed of the synchronous motor from a starting time thereof to a predetermined time for speed controlling matched with a charging voltage of the condenser at an initial stage of the power failure.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

The operation of a apparatus and method for controlling an operation of an elevator car in accordance with the present invention will now be described in detail with reference to the accompanying drawings.

Figure 1:
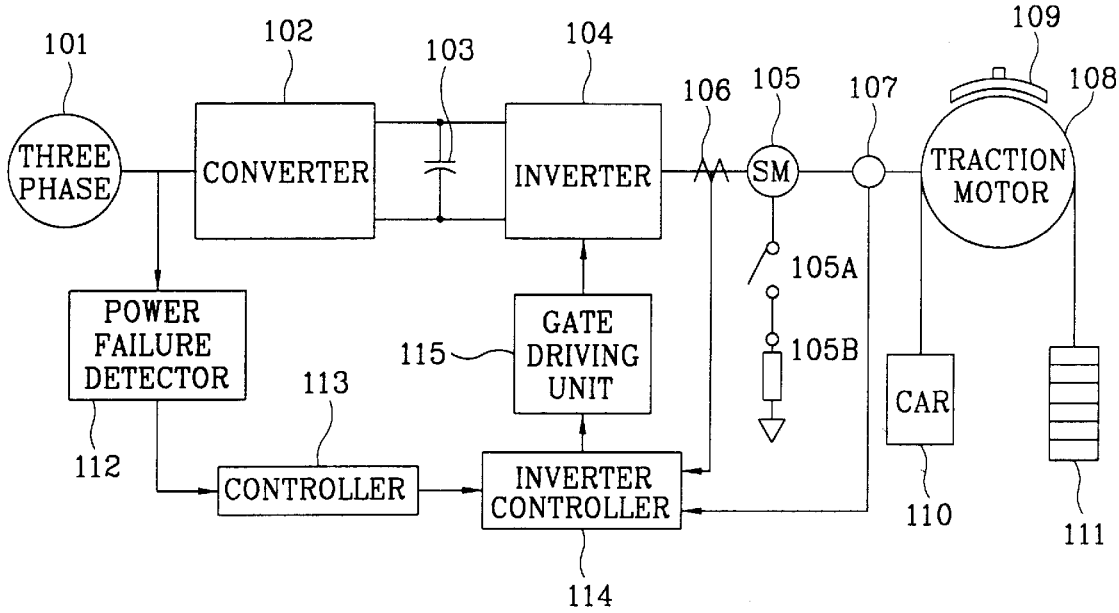
FIG. 1 CONVENTIONAL ART
FIG. 1 is a block diagram illustrating a conventional apparatus for controlling an operation of an elevator car.
Figure 2:
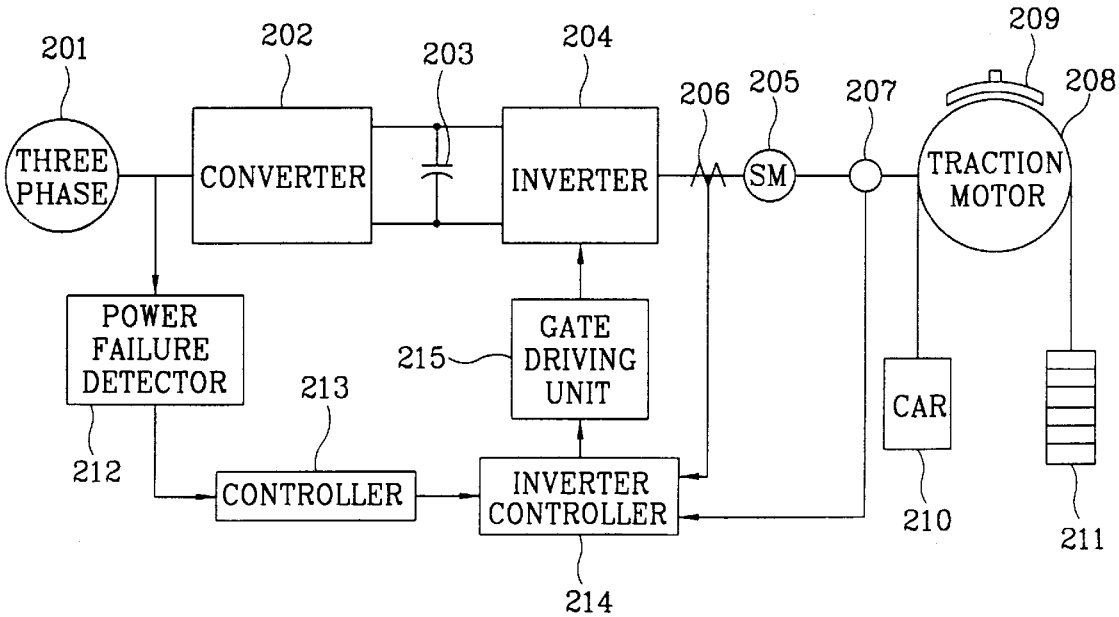
FIG. 2 is a block diagram illustrating an apparatus for controlling an operation of an elevator car in accordance with a first embodiment of the present invention.

FIG. 2 is a block diagram illustrating the apparatus for controlling the operation of the elevator car in accordance with a first embodiment of the present invention. As shown therein, an elevator car 210 is connected to one end portion of the rope, and transfers passengers or cargo. A balance weight 211 is connected to the other end portion of the rope, and keeps a balance with the elevator car 210.

A traction machine 208 moves the car 210 in a vertical direction by winding or releasing the rope. A brake 209 brakes or releases the traction machine 208. The three-phase alternating current synchronous motor 205 provides a driving force rotating the traction machine 208 in a clockwise or counterclockwise, and has a permanent magnet generating an electricity by rotating of a rotor due to a weight difference between the balance weight 211 and the car 210 during the power failure.

The three-phase alternating current power source 201 serve to supply an alternating current of three phases, and the alternating current from the three-phase alternating current power source 201 is converted into a direct current by a converter 202.

An inverter 204 includes switching devices for each phase provided with a gate for switching control, respectively, converts a direct current from the converter 202 into a three-phase alternating current, and outputs it to a motor 205.

A condenser 203 charges, smoothes and outputs a direct current from the converter 202 during the normal operation, and receives generated electricity from the motor 205 through the inverter 204, and charges, smoothes and outputs it during the power failure.

A power failure detector 212 connected to the three-phase alternating current power source 201, and detects the power failure. An output thereof is connected to a controller 213. The controller 213 receives a power failure detection output from the power failure detector 212, and generates a speed command signal and an excitation component current command signal id* of the motor 205.

An encoder of a speed and position detector 207 is connected to an output from the motor 205, and outputs a pulse signal corresponding to a rotation angle of the motor 205.

A current detector 206 is connected to a supply path of the three-phase alternating current outputted from the inverter 204 to the motor 205, detects the currents for each phase, and outputs them to an inverter controller 214. The inverter controller 214 receives the speed command signal ωm* and the excitation component current command signal id* from the controller 213, the current values for each phase from the current detector 206, and the pulse signal from the encoder 207, and outputs voltage command signals of pulse width-modulated three phases.

A gate driving unit 215 drives a gate of the inverter according to the voltage command signal from the inverter controller 214.

Figure 3:
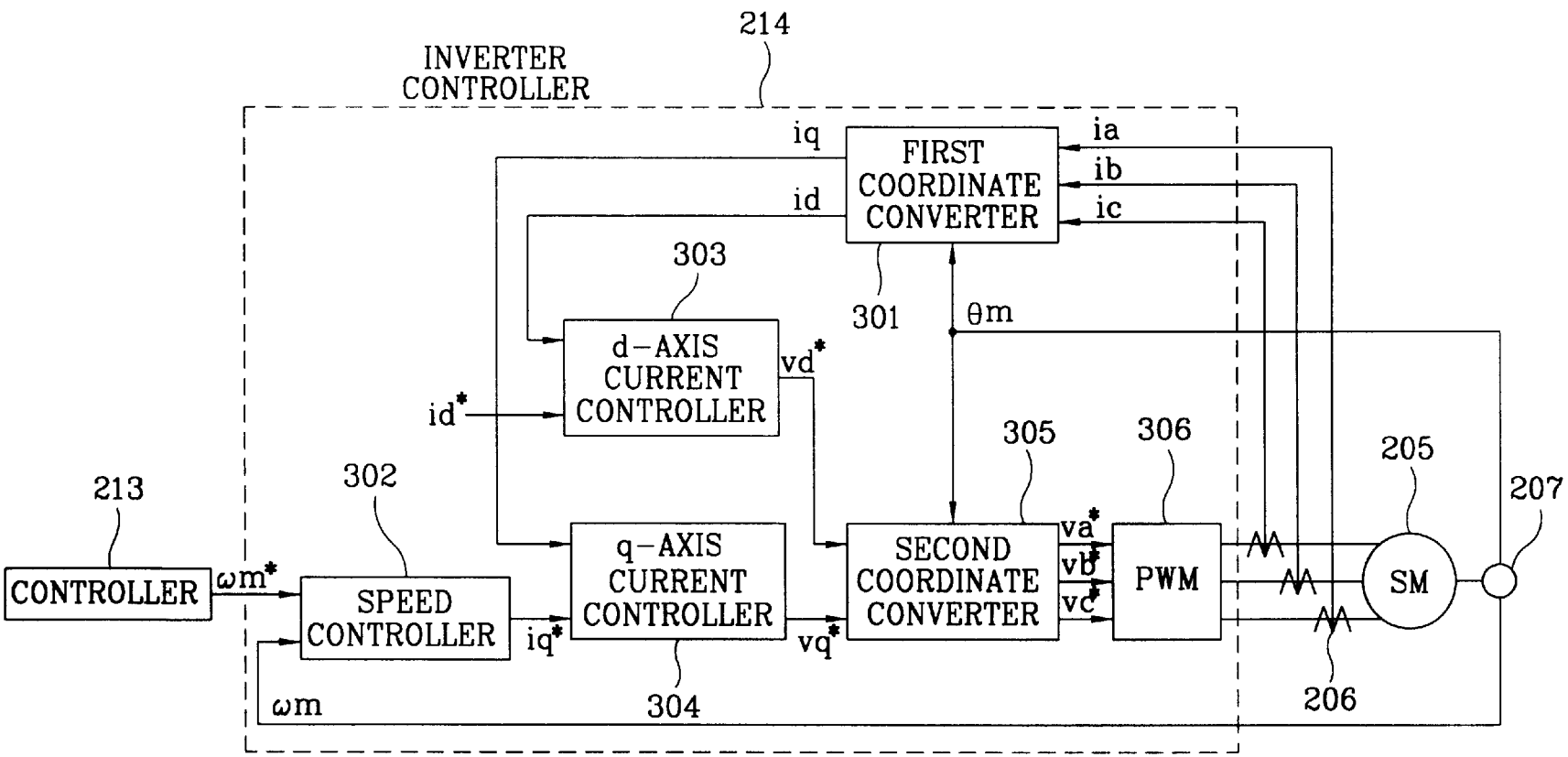
FIG. 3 is a detailed block diagram illustrating an example of an inverter controller in FIG. 2.

FIG. 3 is a detailed block diagram illustrating an example of the inverter controller 214 in FIG. 2. The operation of the inverter controller will now be described.

A speed detector 307 computes a current speed of the car 210 based on the pulse signal from the encoder 207, and outputs a detection speed signal ωm.

A speed controller 302 outputs a torque component current command signal iq* for compensating a difference between a command speed according to the speed command signal ωm* from the controller 213 and a detection speed according to the detection speed signal ωm from the speed detector 302.

A first coordinate converter 301 converts and outputs current signals for each phase ia, ib, ic from the current detector 206 into an excitation component current detection signal id and a torque component current detection signal iq.

An excitation component current controller 303 (so called d-axis current controller) outputs an excitation component voltage control signal Vd* for compensating a difference between an excitation component current command value according to the excitation component current command signal id* from the controller 213 and an excitation component current detection value according to the excitation component current detection signal id from the first coordinate converter 301.

A torque component current controller 304 (so called q-axis current controller) outputs a torque voltage control signal Vq* for compensating a difference between a torque component current detection value according to the torque component current detection signal iq from the first coordinate converter 310 and a torque component current command value according to the torque component current command signal iq* from the speed controller 302.

A second coordinate converter 305 converts and outputs the excitation component voltage control signal Vd* from the excitation component current controller 303 and the torque voltage control signal Vq* from the torque component current controller 304 in to voltage control signals of three phases Va*, Vb*, Vc*.

A pulse width modulator 306 respectively pulse width modulates the voltage control signals of three phases from the second coordinate converter 305, and outputs them to the gate driving unit 215. The operation of the present invention will now be described in detail with reference to FIGS. 4 and 5.

The operation control process during the normal state operation is similar to the conventional art.

The three-phase alternating current power source 201 is converted into the direct current via the converter 202, smoothed through the condenser 203, and supplied as an input power source of the inverter 204.

At this state, when the speed command is inputted from the controller 213 to the inverter controller 214, the inverter controller 214 outputs the gate driving signal to the gate driving unit 215. Accordingly, the switching devices in the inverter 204 are switched, and thus the driving voltage is provided to the synchronous motor 205. The rotation force of the synchronous motor 205 rotating at a speed corresponding to the inputted driving power source is transmitted to the traction machine 208, and the car 210 starts to move to a destination floor.

The gate driving signal outputted from the inverter controller 214 is a pulse width modulation signal having a predetermined pattern generated by receiving the output signal from the current detector 206 and the speed and position detector 207. The pulse width modulation signal is amplified to a predetermined level through the gate driving unit 215, and supplied to the inverter 204.

On the other hand, when the power failure is detected by the power failure detector 212, and when the detection signal is supplied to the controller 213, the driving of the inverter 204 stops. At the same time, the brake 209 of the traction motor is operated, and thus the car 210 stops at a current position.

Here, the auxiliary power source prepared for the emergency such as the power failure is supplied to the controller 213. The controller 213 examines a safety state of a hoist way and a normal/abnormal state of each control circuit, and performs the emergency operation as follows, when there is no abnormality.

Firstly, the brake 209 is released, and thus the car 210 starts to move towards a heavier side between the car 210 and the balance weight 211. That is, when the car 210 is heavier than the balance weight 211, the car 210 moves to a lower direction. In the opposite case, the car 210 moves to an upper direction As described above, when the car 210 starts to move towards one side due to a weight difference between the car 210 and the balance weight 211, the rotation force is transmitted to the synchronous motor 205 through a power transmission system between the car 210 and the synchronous motor 205. thereby rotating the synchronous motor 205.

A stator of the synchronous motor 205 includes the permanent magnet, and thus a rotor cuts a magnetic flux from the permanent magnet. Accordingly, the motor 205 is operated as a generator, thus generating an electricity. The electricity is charged in the condenser 203 through the inverter 204.

In case a charging voltage level of the condenser 203 is increased to a predetermined level, namely to a driving level of the inverter 204, the inverter 204 is controlled by the inverter controller 214 and the gate driving unit 215, thereby controlling the rotation speed and torque of the synchronous motor 205.

That is, when the charging voltage is increased to a predetermined level, the inverter 204 is controlled as in the normal operation mode, and thus the synchronous motor 205 can be driven. Therefore, differently from the conventional art, the contractor and the resistance are not necessary.

On the other hand, the inverter control operation of the inverter controller 214 will now be explained in detail with reference to FIG. 3.

The control operation of the synchronous motor 205 is performed based on the rotation angle of the rotor and the synchronous coordinate system. Here, an in-phase component in regard to the magnet flux of the permanent magnet, namely an excitation component is set to be axis d, and an orthogonal component, namely a torque component is set to be axis q.

The first coordinate converter 301 converts the currents of each phase ia, ib, ic detected from the current detector 206 into the magnetic excitation current id and the torque component current iq on the synchronous coordinate system, centering around the rotation angle θm of the synchronous motor 205 detected by the speed and position detector 207.

The speed controller 302 receives the speed ωm of the synchronous motor 205 detected by the speed and position detector 207 and the speed command ωm* which is an output from the controller 213, and outputs the torque component current command iq*.

On the other hand, the magnetic flux is determined by the permanent magnet, and thus the d-axis current command id* is generally set to be '0'. However, in order to control the magnetic flux of the permanent magnet, it may be set to be a different value.

The d-axis current controller 303 receives the current command id* and the current id converted in the first coordinate converter 301, and outputs the d-axis voltage command Vd*. The q-axis current controller 304 receives the current command iq* outputted from the speed controller 302 and the current iq converted in the first coordinate converter 301, and outputs the q-axis voltage command Vq*. The second coordinate converter 305 coordinate-converts the d-axis and q-axis voltage commands Vd*, Vq*, according to the rotation angle θm, and outputs the command values Va*, Vb*, Vc* of a phase voltage.

The pulse width modulator 306 computes a pulse width of the pulse width modulation signal to be supplied to the gate of the switching device of the inverter 204 according to the command values Va*, Vb*, Vc* of the phase voltage outputted from the second coordinate converter 305, and outputs a corresponding pulse width modulation signal. The switching devices of the inverter 204 are switched according to the pulse width modulation signal, the driving force is supplied to the synchronous motor 205, and thus the torque is generated thereto, thereby controlling the speed of the synchronous motor 205.

When the car 210 reaches to a door zone of the nearest floor by operating the synchronous motor 205 at a low speed through the inverter controller 214, the door is opened in order for the passengers to get off.

However, the electricity generated from the synchronous motor 205 is slight at an initial stage of the emergency operation, and thus a level of the direct current voltage outputted from the condenser may be lower than a rated value. Accordingly, the speed control may not be smoothly performed by using the speed controller 302. Thus, in order to smoothly control the synchronous motor 205 during the emergency operation, it is necessary to limit the torque component current command iq* below the rated value until the voltage is sufficiently charged in the condenser 203 after starting the emergency operation of the car 210. That is, it is necessary to gradually increase a limit value of the torque component current command iq* which is the output from the speed controller 302 according to the rotation speed of the synchronous motor 205 or the time elapsed.

Also, the level of the charging direct current voltage of the condenser 203 may be lower than the rated value before the synchronous motor 205 is rotated and accelerated at a predetermined speed. Accordingly, it is necessary to limit the output values of the dais and q-axis voltage commands Vd*, Vq* of the d-axis current controller 303 and the q-axis current controller 304 according to the rotation speed of the synchronous motor 205 or the time elapsed after the starting of the motor 205.

That is to say, the limit values of the d-axis and q-axis voltage commands Vd*, Vq* of the d-axis current controller 303 and the q-axis current controller 304 are gradually increased according to the rotation speed of the synchronous motor 205 or the time elapsed. As another example, to limit the command values Va*, Vb*, Vc* of the phase voltage outputted from the second coordinate converter 305 obtains the same effect.

Figure 4:
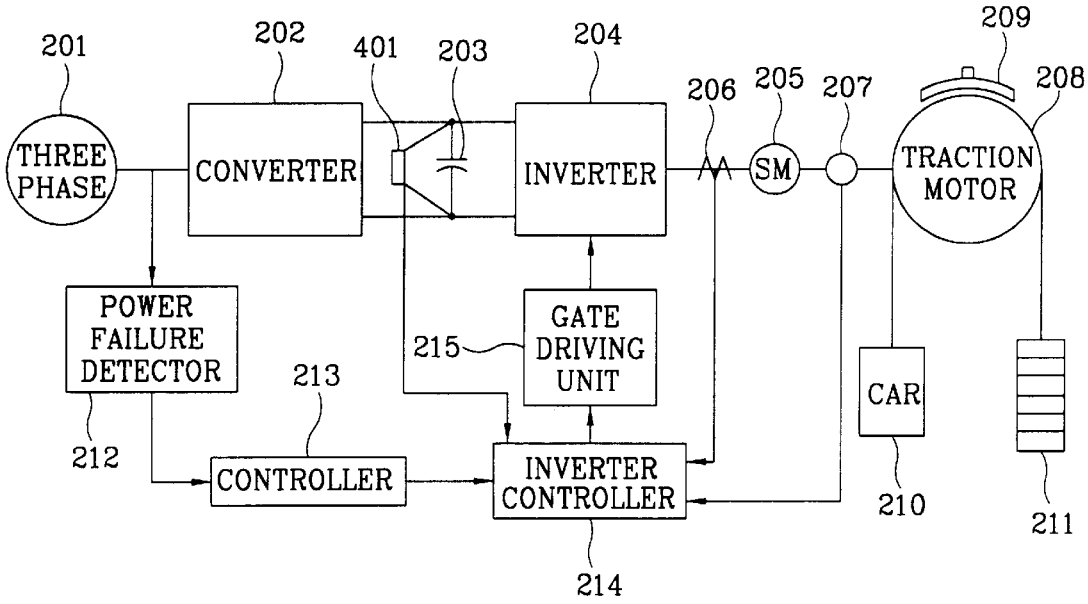
FIG. 4 is a block diagram illustrating an apparatus for controlling an operation of an elevator car in accordance with a second embodiment of the present invention.
Figure 5:
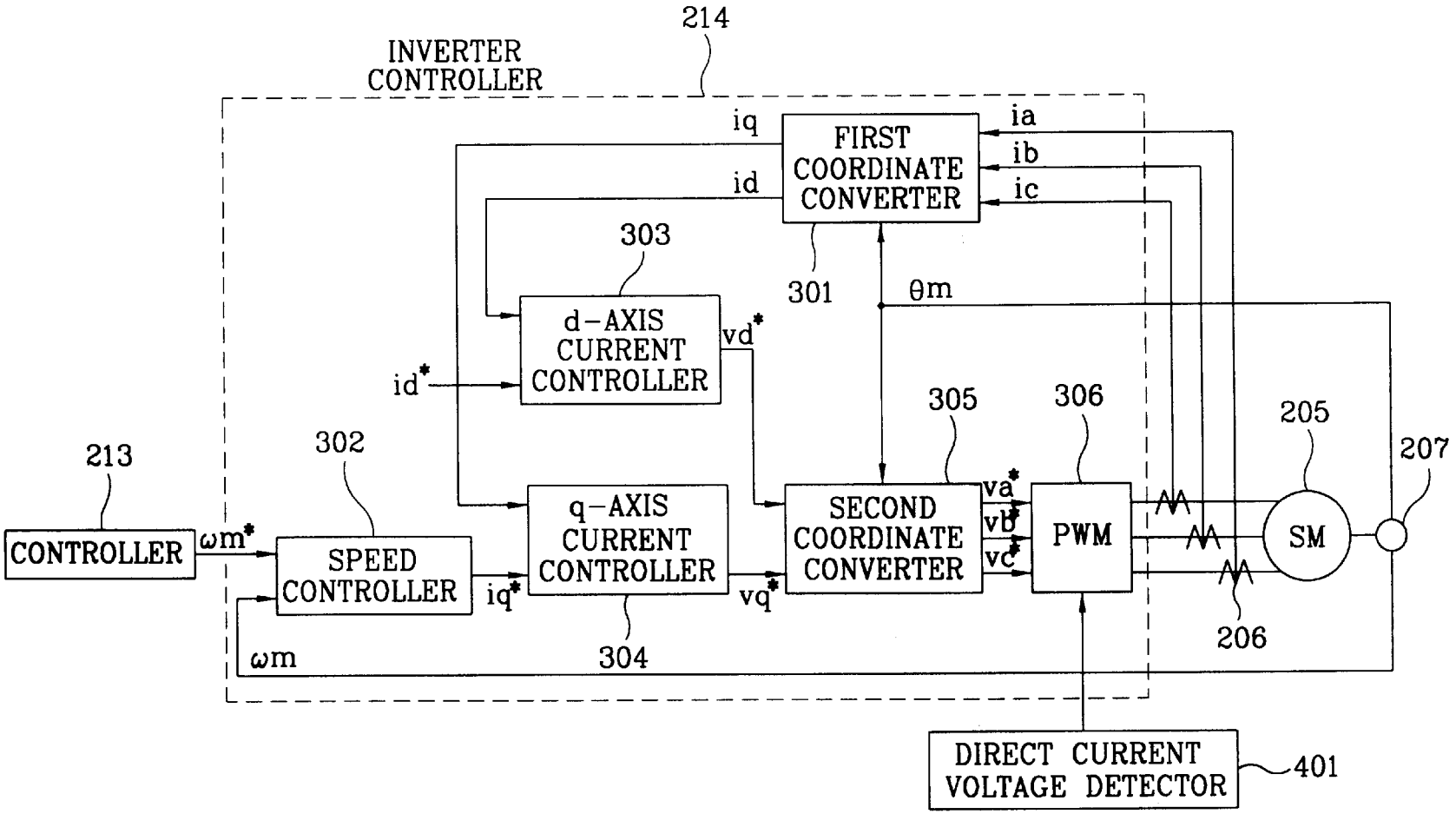
FIG. 5 is a block diagram illustrating an apparatus for controlling an operation of an elevator car in accordance with a third embodiment of the present invention.

As discussed earlier, the direct current voltage is charged in the condenser 203 by the back electromotive force generated according to the rotation of the synchronous motor 205, and thus the direct current voltage supplied to the inverter 204 can not maintain a constant potential. In order to exactly synthesize the command values Va*, Vb*, Vc* of the phase voltage in the pulse width modulator 306, it is required to exactly know the level of the varied direct current voltage. As illustrated in FIG. 4, it is possible to exactly measure the level of the direct current voltage to be varied, by adding a direct current voltage detector 401 measuring a direct current voltage charged in the condenser 203, and outputting it to the inverter controller. The pulse width modulator 306 outputting the pulse width modulation signal to the gate driving unit 215 controls a pulse width modulation signal generating time according to the output from the direct current voltage detector 401. That is, in accordance with the output from the direct current voltage detector 401, when the direct current voltage charged in the condenser 203 is lower than the rated value, a pulse width of the pulse width modulation signal is controlled to be short, and when the direct current voltage is higher than the rated value, the pulse width thereof is controlled to be long, or to be gradually increased.

As described above, in accordance with the present invention, when the emergency such as the power failure takes place, the car is not operated by the weight difference between the car and the balance weight, and the ground resistance value. That is to say, the low-speed emergency operation is operated by controlling the speed and torque of the synchronous motor through the inverter with the back electromotive force of the motor. Accordingly, a special device is not required, which results in the reduced fabrication cost. In addition, the emergency operation may be stably performed.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A method for controlling a rescue operation of an elevator car during a power failure by using an elevator system including:

a rope;

an elevator car connected to one end portion of the rope, and transferring passengers or cargo;

a balance weight connected to the other end portion of the rope, and keeping the balance with the elevator car;

a traction pulley for moving the car in a vertical direction by winding or releasing the rope;

a three-phase alternating current synchronous motor for providing a driving force rotating the traction pulley in a clockwise or counterclockwise direction during the normal operation, and provided with a permanent magnet generating electric power by rotating due to a weight difference between the balance weight and the car during the power failure;

a three-phase alternating current power source for supplying an alternating current power;

a converter for converting an alternating current from the three-phase alternating current power source into a direct current;

an inverter having switching devices, each device provided with a gate for being controlled, for inverting a direct current from the converter into a three-phase alternating current, and outputting it to the motor;

a condenser for charging, smoothing and outputting a direct current from the converter during the normal operation, and receiving an electricity generated from the motor through the inverter, and charging, smoothing and outputting it during the power failure;

a power failure detector connected to the three-phase alternating current power source for detecting the power failure;

a controller for receiving a power failure detection output from the power failure detector and for outputting a speed command signal and an excitation component current command signal to the motor;

an encoder outputting a pulse signal corresponding to a rotation angle of the motor;

a current detector for detecting and outputting each phase current of the three-phase alternating current outputted from the inverter to the motor;

an inverter controller outputting voltage command signals of pulse width-modulated three phases on the basis of the speed command signal and the excitation component current command signal from the controller, each phase current from the current detector, and the pulse signal from the encoder;

a gate driving unit for controller driving a gate of the inverter; and a direct current voltage detector for detecting a direct current voltage at both ends of the condenser and supplying it to the inverter controller, wherein, the inverter controller including;

a speed detector for detecting a current speed of the car according to the pulse signal from the encoder, and outputting a detection speed signal;

a speed controller for outputting a torque component current command signal compensating for a difference between a command speed according to the speed command signal from the controller and a detection speed according to the detection speed signal from the speed detector;

a first coordinate converter for converting and outputting the current signals for each phase from the current detector into an excitation component current detection signal and a torque component current detection signal according to the pulse signal from the encoder;

an excitation component current controller for outputting an excitation component voltage control signal compensating for a difference between an excitation component current command value according to the excitation component command signal from the controller and an excitation component current detection value according to the excitation component current detection signal from the first coordinate converter;

a torque component current controller for outputting a torque voltage control signal to compensate a difference between a torque component current detection value according to the torque component current detection signal from the first coordinate converter and a torque component current command value according to the torque component current command signal from the speed controller;

a second coordinate converter for converting and outputting the excitation component voltage control signal from the excitation component current controller and the torque voltage control signal from the torque component current controller into voltage control signals of three phases according to the pulse signal from the encoder; and a pulse width modulator for pulse width modulating and outputting the voltage control signals of three phases outputted from the second coordinate converter, the method comprising;

a step for obtaining the electricity generated by rotating the synchronous motor due to the weight difference between the balance weight and the car during the power failure;

a step for charging the electricity in the condenser; and a step for gradually increasing a rotation speed of the synchronous motor from a starting time thereof to a predetermined time for speed controlling matched with a charging voltage of the condenser at an initial stage of the power failure.

2. The method according to claim 1, wherein the speed controller gradually increases the torque component current command value for a predetermined time in order to gradually increase the rotation speed of the motor.

3. The method according to claim 1, wherein the excitation component current controller gradually increases the excitation component voltage control value, and the torque component current controller gradually increases the torque component voltage control value, in order to gradually increase the rotation speed of the motor.

4. The method according to claim 1, wherein the second coordinate converter gradually increases the control voltage values for each phase according to the voltage control signals of three phases, in order to gradually increase the rotation speed of the motor.

5. The method according to claim 1, wherein the pulse width modulator gradually increases the pulse width during the pulse width modulation, in order to gradually increase the rotation speed of the motor.

* * * * *